US005215211A

United States Patent [19]

Eberle

[11] Patent Number: 5,215,211

[45] Date of Patent: Jun. 1, 1993

[54] SHEET MATERIAL DISPENSER

[75] Inventor: Kurt P. Eberle, New Brunswick, Canada

[73] Assignee: Merfin Hygienic Products Ltd., Delta, Canada

[21] Appl. No.: 736,102

[22] Filed: Jul. 26, 1991

[51] Int. Cl.[5] ..... B65H 3/28

[52] U.S. Cl. ..... 221/1; 221/46; 221/61; 221/63; 221/197; 221/281; 225/90; 225/106; 225/15

[58] Field of Search ..... 221/1, 45, 46, 61, 62, 221/63, 197, 281, 283, 287; 242/55.2, 55.53, 55.54; 225/15, 90, 106

[56] References Cited

U.S. PATENT DOCUMENTS 2,806,591 9/1957 Appleton .
3,310,167 3/1967 Knox .
3,908,822 9/1975 Giberstein .
4,107,390 10/1979 McCabe .
4,180,160 12/1979 Ogawa et al. ..... 221/63 X
4,583,642 4/1986 Blythe et al. .
4,648,530 10/1987 Granger ..... 221/63 X
4,694,973 9/1987 Rose et al. .
4,863,027 9/1989 Yano .

FOREIGN PATENT DOCUMENTS 2145693 4/1985 United Kingdom ..... 221/46

*Primary Examiner*—David H. Bollinger
*Attorney, Agent, or Firm*—Hughes & Multer

[57] ABSTRACT

The specification discloses a sheet material dispenser for which the angle between axis along which sheet material is dispensed and the dispenser container may be changed. A dispensing funnel is provided on a ball that rotates about its center within a socket mounted on the container. Sheet material extends from the center of a stationary supply of sheet material around a guide bar, through openings in the ball and the container, and to the exterior of the container through the opening of the funnel. Sheet material is manually extracted from the funnel. A stabilizing member extends into a hollow core to the supply of sheet material to stabilize the supply. An access hole is formed in the container to allow adjustment and refeeding of sheet material without unlocking the container.

23 Claims, 5 Drawing Sheets

SHEET MATERIAL DISPENSER

TECHNICAL FIELD OF THE INVENTION

The present invention relates to sheet material dispensers and, more specifically, to novel, improved sheet material dispensers designed such that the angle at which sheet material is dispensed may be changed, a supply roll of interconnected sheet material is stabilized during dispensing, sheet material is guided towards a dispensing port to prevent jamming, and sheet material may easily be adjusted within the machine should such sheet material become jammed.

BACKGROUND OF THE INVENTION

A number of sheet material dispensers and other superficially related dispensers have heretofore been proposed. Those of which applicant is aware are disclosed in: (a) U.S. Pat. No. 2,806,591, issued 17 September 1957 to Appleton for "DISPOSABLE TISSUE RECEPTACLE"; U.S. Pat. No. 4,583,642, issued 22 April 1986 to Blythe et al. for "DISPENSING PACKAGE FOR A COLLECTION OF INTER-CONNECTED SEVERABLE SHEET MATERIAL AND METHOD OF DISPENSING"; U.S. Pat. No. 3,908,822, issued 30 September 1975 to Giberstein for "DEVICE FOR PACKAGING AND PRESENTATION OF KNITTED OR HOSIERY ARTICLES SUCH AS, MORE PARTICULARLY, STOCKINGS OR TIGHTS"; U.S. Pat. No. 4,170,390, issued 9 October 1979 to McCabe for "PAPER TOWEL DISPENSER"; U.S. Pat. No. 3,310,167, issued 21 March 1967 to Knox for "RIBBON DISPENSER"; U.S. Pat. No. 4,694,973, issued 22 September 1987 to Rose et al. for "WARMING DEVICE FOR DISPOSABLE TOWEL DISPENSER"; and U.S. Pat. No. 4,863,027, issued 5 September 1989 to Yano for "BAG ROLL CUTTING DEVICE"; and (b) a brochure for Merfin's "SINGLE SHEET PAPER TOWEL DISPENSER".

Each of the foregoing references contains drawbacks rendering the sheet material dispensers disclosed therein inflexible and/or inefficient for dispensing of sheet material. For example, all of the references cited above have fixed dispensing orifices. Accordingly, the towel dispenser disclosed therein are severely limited in mounted options because their fixed dispensing orifices prescribe the mounting position.

In addition, none of these references allow adjustment and correction of the sheet material contained therein when such sheet material is jammed, without opening the container in which the sheet material is stored.

The McCabe and Yano patents disclose means for stabilizing rolls of interconnected sheets. However, the sheets in those patent are dispensed from the outside of the supply rolls. The stabilizing means disclosed therein could not be adapted to stabilize a supply roll of sheet material that dispenses sheets from the center.

In the above-cited Knox and McCabe patents, elongate orifices are disclosed that, effectively, guide interconnected sheets out of a dispensing orifice. Niether of the guiding orifices of the dispensers disclosed in Knox and McCabe would be effective at guiding sheets off of a roll of sheets when sheets are drawn from the center of the roll of sheets and the roll of sheets is stationary. Accordingly, the guiding action disclosed in these patents would be ineffective in a wide variety of situations.

SUMMARY OF THE INVENTION

Disclosed herein is a new and novel sheet dispenser that does not contain any of the above-discussed, or other, disadvantages of heretofore proposed sheet dispensers.

Generally speaking, the novel sheet material dispenser disclosed herein includes a container for containing a supply of sheets in roll form, a cover for covering a service opening of the container, and a dispenser mounted on the container and having a dispensing orifice with a dispensing axis defined therethrough, wherein the angle between the container and the dispensing axis is changeable by moving the dispenser. By moving the dispenser, sheets may be dispensed to a person standing in different places relative to the sheet dispenser.

In addition, the sheet dispenser of the present invention may include one or more guide bars mounted within the container for guiding the connected sheets from the supply of such connected sheets to the dispenser. Providing such a guide bar or guide bars allows placement of the dispenser at different locations on the container, depending at different locations on the container, depending on the desired mounting location of the container, such that jamming of the connected sheets along the sheet path is prevented.

Another embodiment of the sheet dispenser disclosed herein provides a stabilizer that partially penetrates a hole in the center of the supply of connected sheets to stabilize the supply. The supply is thus prevented from caving in upon itself after most of the sheets have been dispensed from the supply. The stabilizer may be movable to allow easy loading of the supply of connected sheets.

Additionally, an access opening may be provided in the container along the sheet path to allow adjustment of the sheets along a sheet dispensing path without opening of the cover, which may be locked and accessible only by personnel of a janitorial or maintenance service.

The dispenser of the present sheet dispenser may be a ball and socket arrangement having a dispensing nozzle protruding from the ball. The sheet material is dispensed through a dispensing orifice in the nozzle, and the ball is rotatable within the socket such that the dispensing angle is changeable.

OBJECTS OF THE INVENTION

From the foregoing, it is apparent that the proviso of a novel, improved sheet dispenser is one primary and important object of the invention.

Other, also important, but more specific objects of the invention include the provision of a sheet dispenser that:

(a) allows easy dispensing of sheets to persons standing in various positions in relation to the sheet dispenser;

(b) allows flexible installation of the sheet dispenser;

(c) allows provision of a dispenser at different places on the container of the sheet dispenser;

(d) prevents jamming of the sheets within the sheet dispenser;

(e) allows easy access to a sheet path within the sheet dispenser so that jamming and/or obstructions in the sheet path may be cleared;

(f) stabilizes a supply roll of connected sheets contained in the sheet dispenser; and (g) allows easy installation of replacement supply rolls of connected sheets.

DETAILED DESCRIPTION OF THE INVENTION

Figure 1:
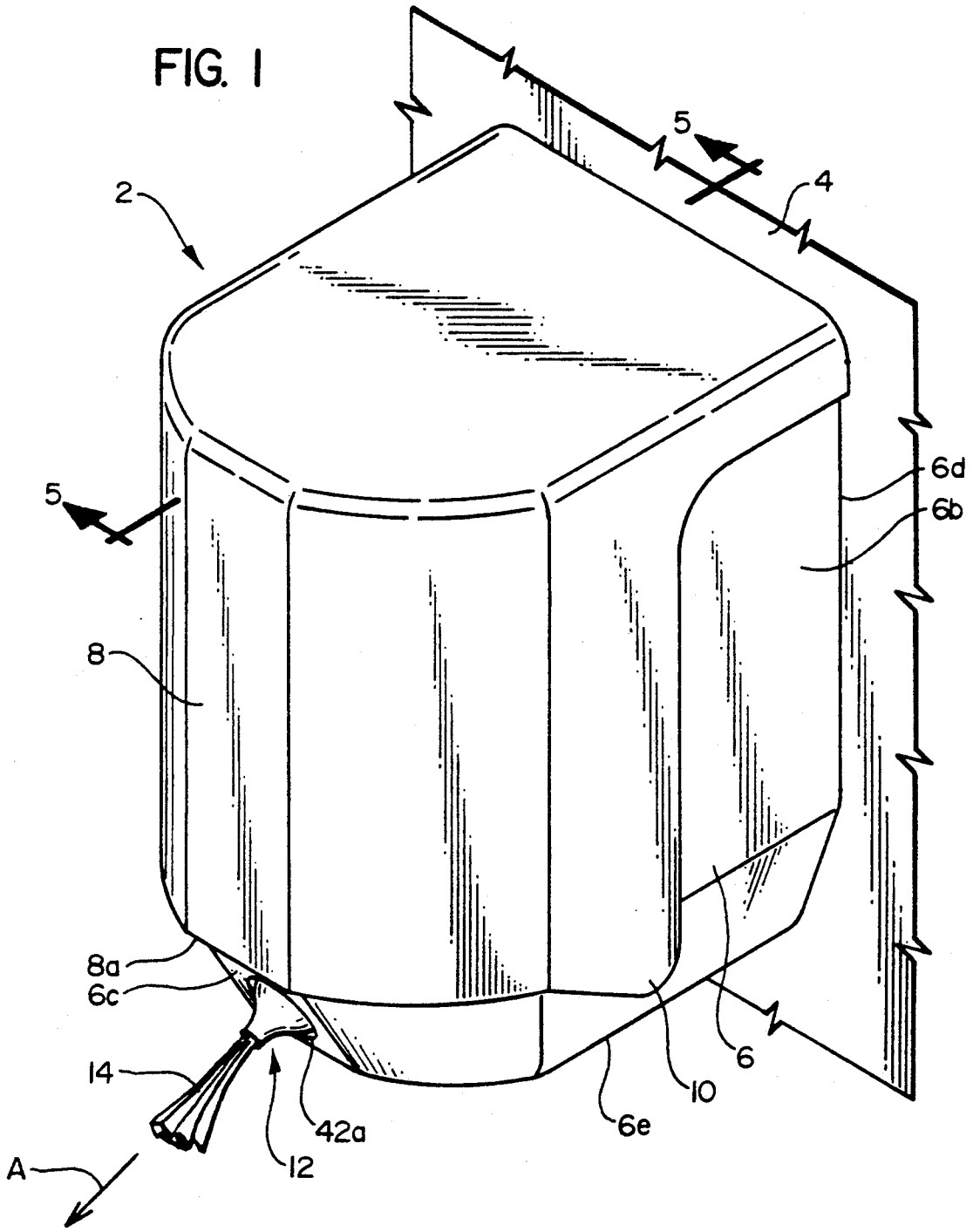
FIG. 1 is a perspective view of the sheet dispenser of the preferred embodiment.

Referring now to the drawing, FIG. 1 depicts a sheet dispenser 2 constructed in accordance with, and embodying, the principles of the present invention. Sheet dispenser 2 is mounted on a mounting surface 4.

A cover 8 is rotatably attached to a container 6 by hinges schematically indicated at 9 (FIGS. 3 and 4) under hinge ears 10. Cover 8 rotates about a hinge axis indicated by reference character 9*a* (FIG. 2).

The container 6 has left side, right side, front, rear, and bottom walls 6*a*, 6*b*, 6*c*, 6*d*, and 6*e*, respectively. A dispenser 12 is mounted on the lower front portion of container 6. Sheet material, indicated by reference character 14, is dispensed through dispenser 12 along a dispensing axis indicated by reference character A (see FIG. 4).

Figure 2:
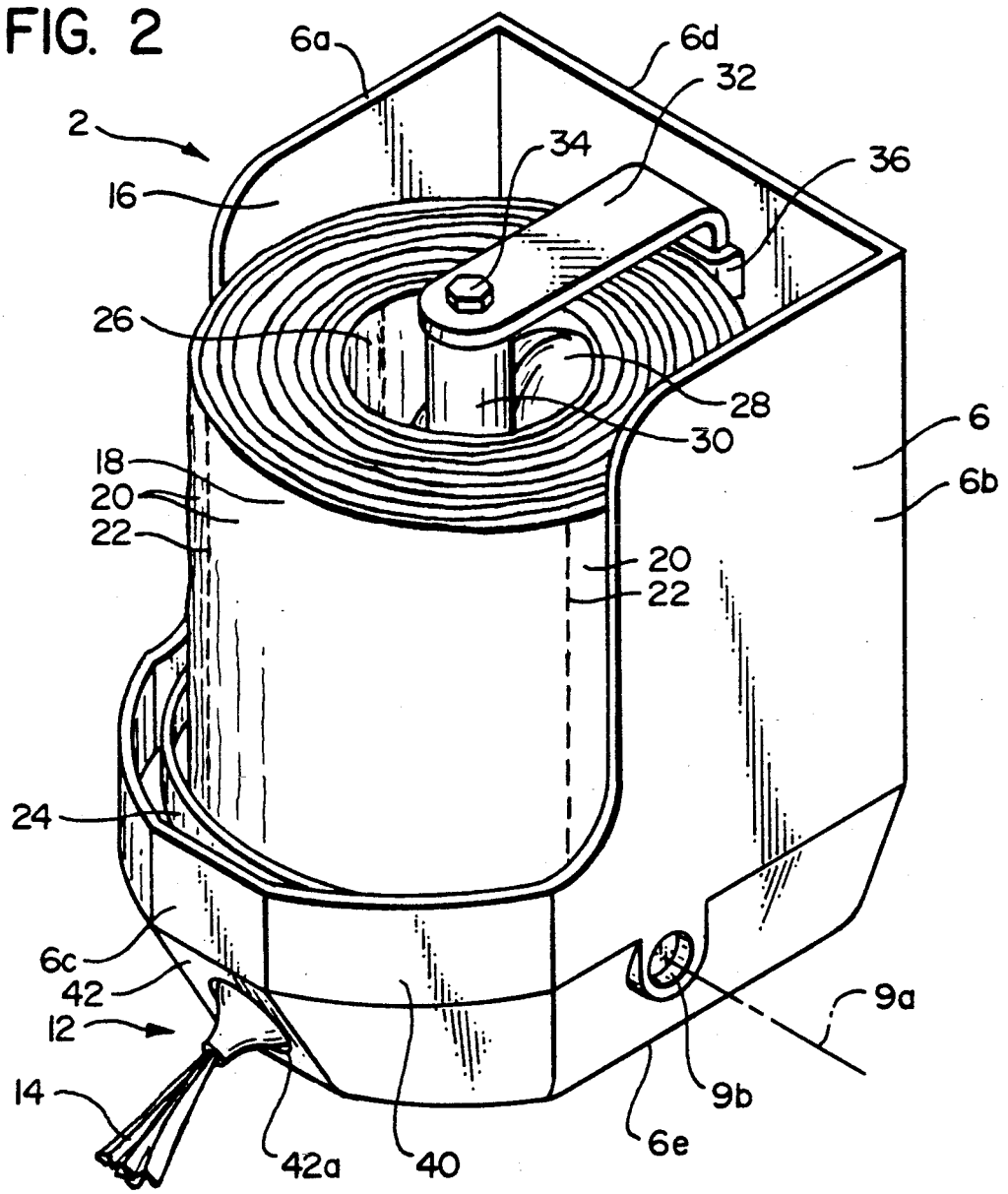
FIG. 2 is a perspective view of the sheet dispenser with its cover removed showing a roll of connected sheets and a stabilizer of the preferred embodiment.
Figure 3:
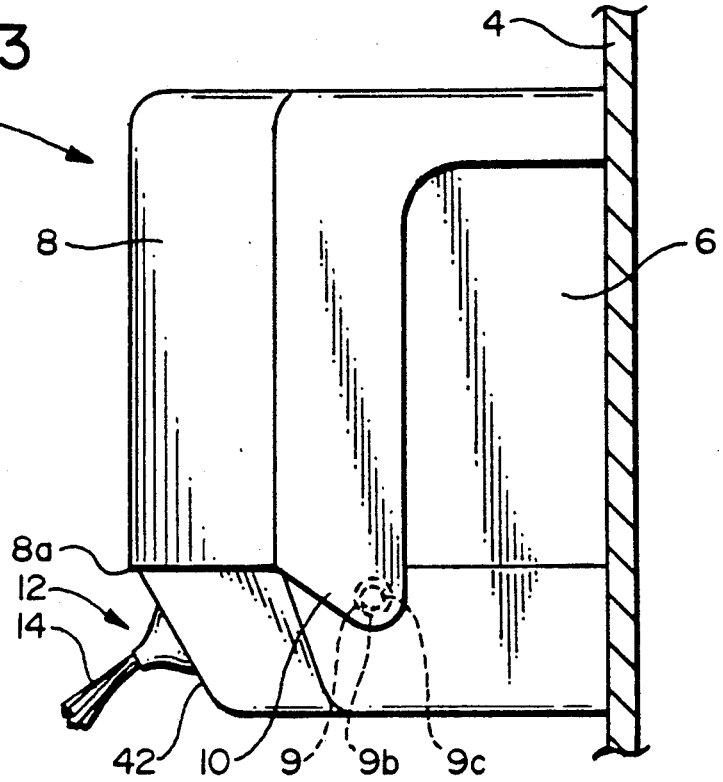
FIG. 3 is a side view of the sheet dispenser with its cover in a closed position.

FIG. 2 depicts sheet dispenser 2 with cover 8 removed. A service opening 16, which is formed in container 6, allows a supply roll 18 to be inserted into or removed from container 6 and also allows cleaning and maintenance of the interior thereof. Service opening 16 extends over the entire top portion of container 6 and through a substantial portion of front 6C of the container 6.

Supply roll 18 consists of a series of individual sheets 20. The individual sheets 20 in supply roll 18 are connected to two adjacent individual sheets 20 at perforated junctions 22. By application of an appropriate force along perforated junctions 22, adjacent individual sheets 20 may easily be separated from each other.

Supply roll 18 sits within container 6 on a support member 24. In this embodiment, supply roll 18 does not move relative to support member 24; instead, the point at which sheet material 14 is removed from hollow core 26, indicated by reference character 28, spirals outward around the center of core 26. As sheet material 14 is removed from supply roll 18, the diameter of hollow core 26 increases and the thickness of rolled individual sheets 20 decreases until the final, outside layer of individual sheets 20 is removed, at which time sheet dispenser 2 is empty.

A stabilizing bar 30 is connected to an L-shaped bracket 32 by a screw 34. L-shaped bracket 32 is slideably mounted on the back wall 6*d* of container 6 by U-shape mounting brackets 36. L-shaped bracket 32 slides up into a loading position and down into a stabilizing position relative to container 6 such that stabilizing bar 30 is removed from or partially inserted into hollow core 26 of supply role 18. When bracket 32 is in the loading position, bracket 32 and stabilizing bar 30 protrude through service opening 16 (FIG. 4) to allow roll 18 to be loaded into container 6.

A female portion 96 of one of hinges 9 rotatably attaches cover 8 onto container 6. Male portions schematically indicated at 9C (FIGS. 3 and 4) of the hinges 9 are located on the inside surfaces of cover 8 at hinge ears 10. Hinge ears 10 cover female portions 38*a*, and female portions 38*a* mate with the male portions 38*b* of the hinges, when cover 8 is attached to container 6.

A front portion 40 of container 6 is generally curved to conform to the curved outer surfaces of support member 24 and supply roll 18.

In this embodiment, a flat surface 42 is formed on front portion 40. Dispenser 12 is attached to container 6 at flat surface 42. Flat surface 42 is downwardly slanted to prevent cover 8 from contacting and interfering with dispenser 12 when cover 8 is rotated away from the closed position. More particularly, as a front edge 8*a* of cover 8 downwardly rotates about the hinge axis 9, it swings outward away from dispenser 12 and does not contact the dispenser 12. When front edge 8*a* contact bottom wall 6*e* of container 6, cover 8 is fully rotated into the open position.

Figure 4:
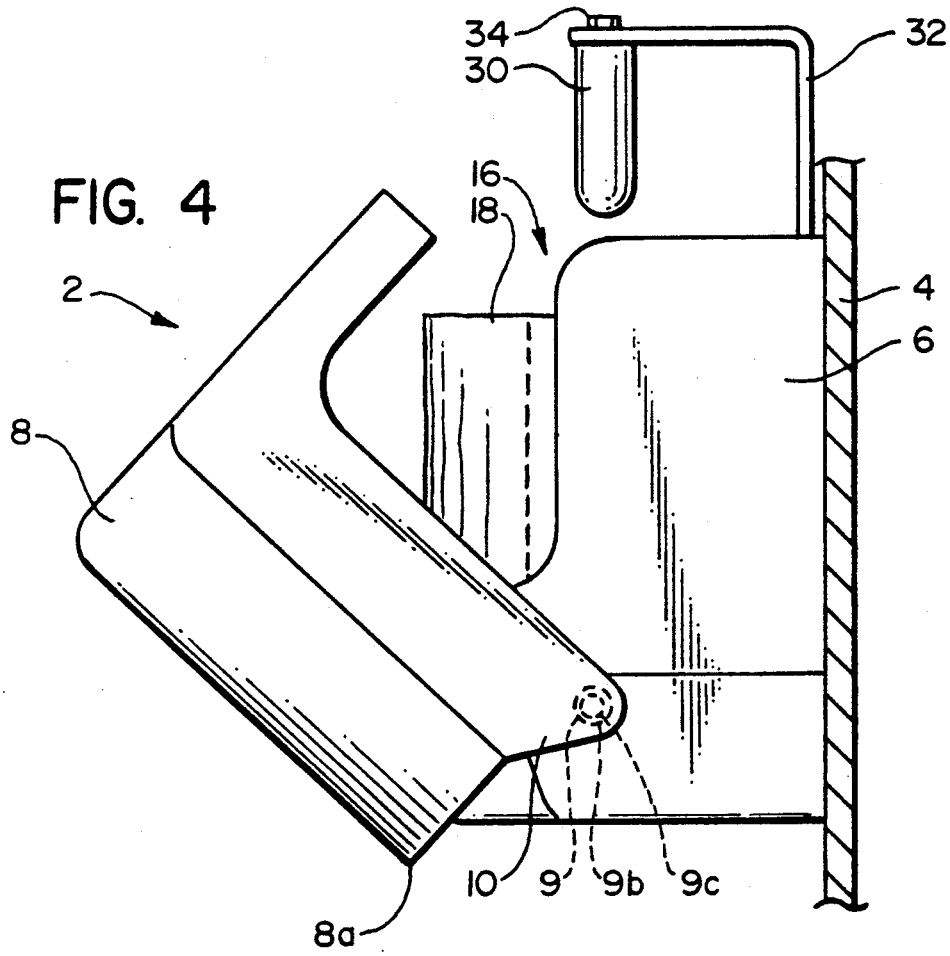
FIG. 4 is a side view of the sheet dispenser with its cover partially opened.

The supply roll 18 may be inserted into or removed from container 6 through service opening 16 formed therein when cover 8 is opened as shown in FIG. 4.

In this embodiment, dispenser 12 comprises a hollow ball 44 revolving within a socket 46 attached to the inside of flat surface 42 by screws 51. Inner surface 46*a* around hole 46*b* in socket 46 is semi-spherical and concentric with a circular orifice 42*a* in flat surface 42. A bevelled edge 42*b* around orifice 42*a* is formed on flat surface 42. A semi-spherical surface 42*c* around orifice 42*a* is contiguous with inner surface 46*a*, and these contiguous surfaces form a semi-spherical socket surface 47. The outer, spherically-shaped surface of ball 44 has a slightly smaller radius of curvature than socket surface 47. Ball 44 thus mates with similarly formed semi-spherical socket surface 47 formed by contiguous inner surfaces 46*a* of socket 46 and 42*c* around orifice 42*a*. A funnel 48 extends from ball 44 towards the outside of dispenser 2.

A first circular opening 44*a* is formed in ball 44 at the point at which opening 48*a* of funnel 48 intersects ball 44. A path is thus created from the interior of ball 44, through opening 48*a*, to the exterior of container 6.

Figure 6:
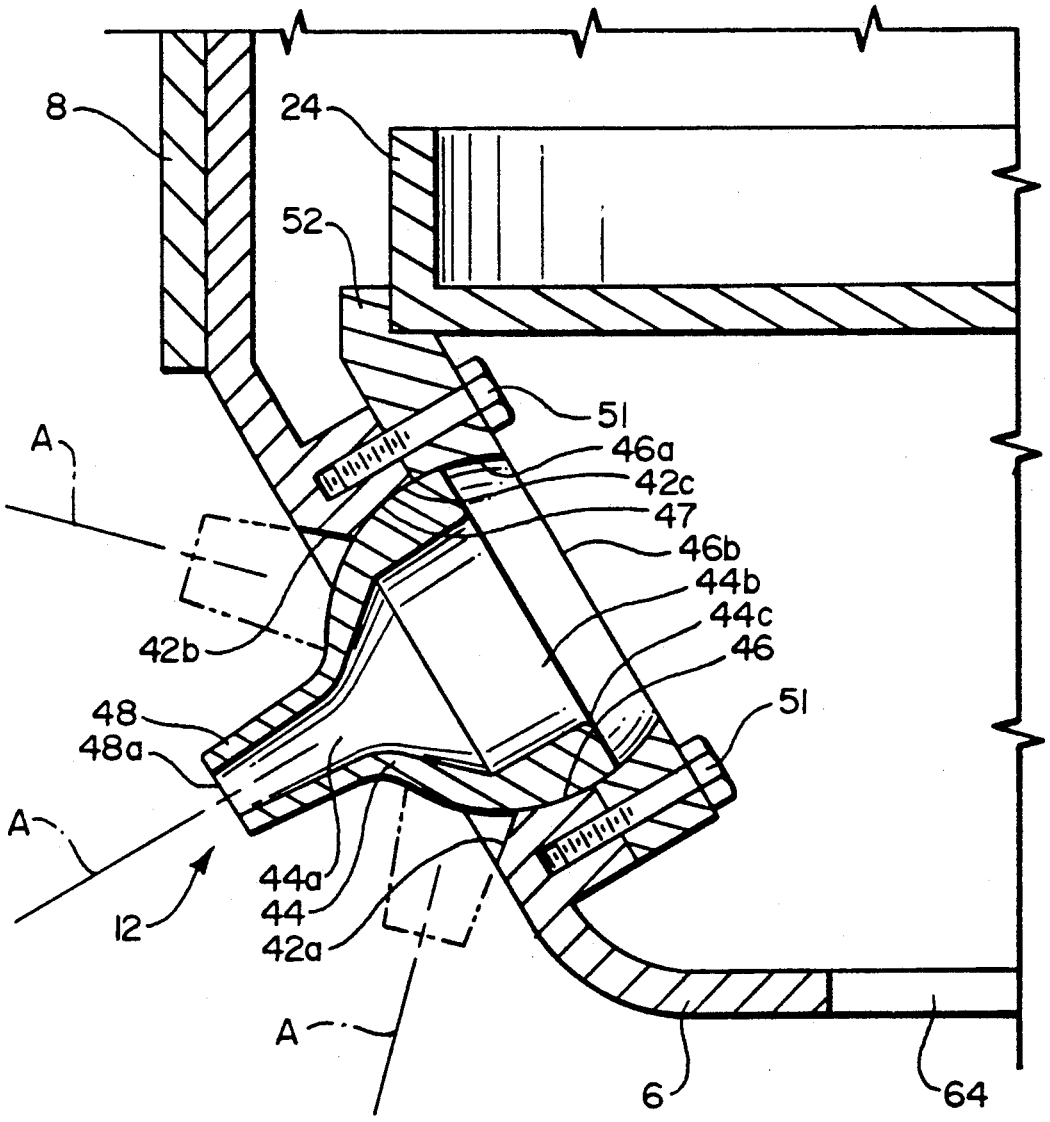
FIG. 6 is an enlarged view of the preferred embodiment depicting the details of the dispenser through which sheet material is manually extracted.

A second circular opening 44*b* is formed in ball 44 opposite first opening 44*a* (FIG. 6). The dimensions of opening 44*b* are determined according to the following criteria: (a) the opening 44*b* should not be so large that ball 44 pops out of socket 46 when funnel 48 is moved into an extreme position in which funnel 48 contacts edge 42*b* of lower front surface 42; and (b) the opening 44*b* should be wide enough to allow sheets 14 to pass therethrough when funnel 48 is moved into the extreme position. If opening 44*b* is too small and interferes with sheet material 14, a bevelled edge 44*c* around opening 44*b* could exert sufficient force along a seam 22 of interconnected sheets 20 to separate one such sheet from another inside container 6. End 14*a* of sheet material 14 would then need to be re-fed through the opening 48*a* in funnel 48.

The dispensing axis indicated by reference character A extends through the opening 48*a* in the funnel 48.

When ball 44 revolves within socket 46, a dispensing angle between dispensing axis A and flat surface 42 is changed. Broken lines in FIG. 5 indicate the position of funnel 48 when ball 44 is moved within socket 46 in a limited range between upper and lower positions. Funnel 48 contacts edge 42*b* of flat surface 42 to define the range of movement between the extreme upper and lower positions. While the movement of ball 44 within socket 46 is shown in two dimensions in the drawing, such a ball and socket arrangement allows the ball to rotate or revolve in all directions about the center of the ball.

A notched mounting projection 52 is formed on the upper end of socket 46. Support member 24 is mounted at one end on notched mounting projection 52 and at the other end on a mounting ledge 54 formed on the inner back surface of container 6.

Support member 24 has a hole 56 formed therein that is substantially coaxial with hollow core 26 of supply role 18. Further, as shown in FIG. 5, stabilizing bar 30 is also substantially coaxial with hollow core 26 and extends partially in this embodiment approximately one-third of the way, into hollow core 26.

A guide bar 58 is mounted on mounting ears 60 downwardly extending from support member 24. In this embodiment, with the dispenser 12 located at the front of container 6, guide bar 58 is mounted such that it is substantially parallel to flat surface 42 and perpendicular to the sides of container 6. Guide bar 48 is mounted slightly toward dispenser 12 from the vertical axis of hollow core 26.

A stop ledge 62 is formed on the inside of back wall 6*d* of container 6. L-shaped bracket 32 contacts stop ledge 62 when stabilizing bar 30 is extended into hollow core 26 of supply role 18.

Figure 5:
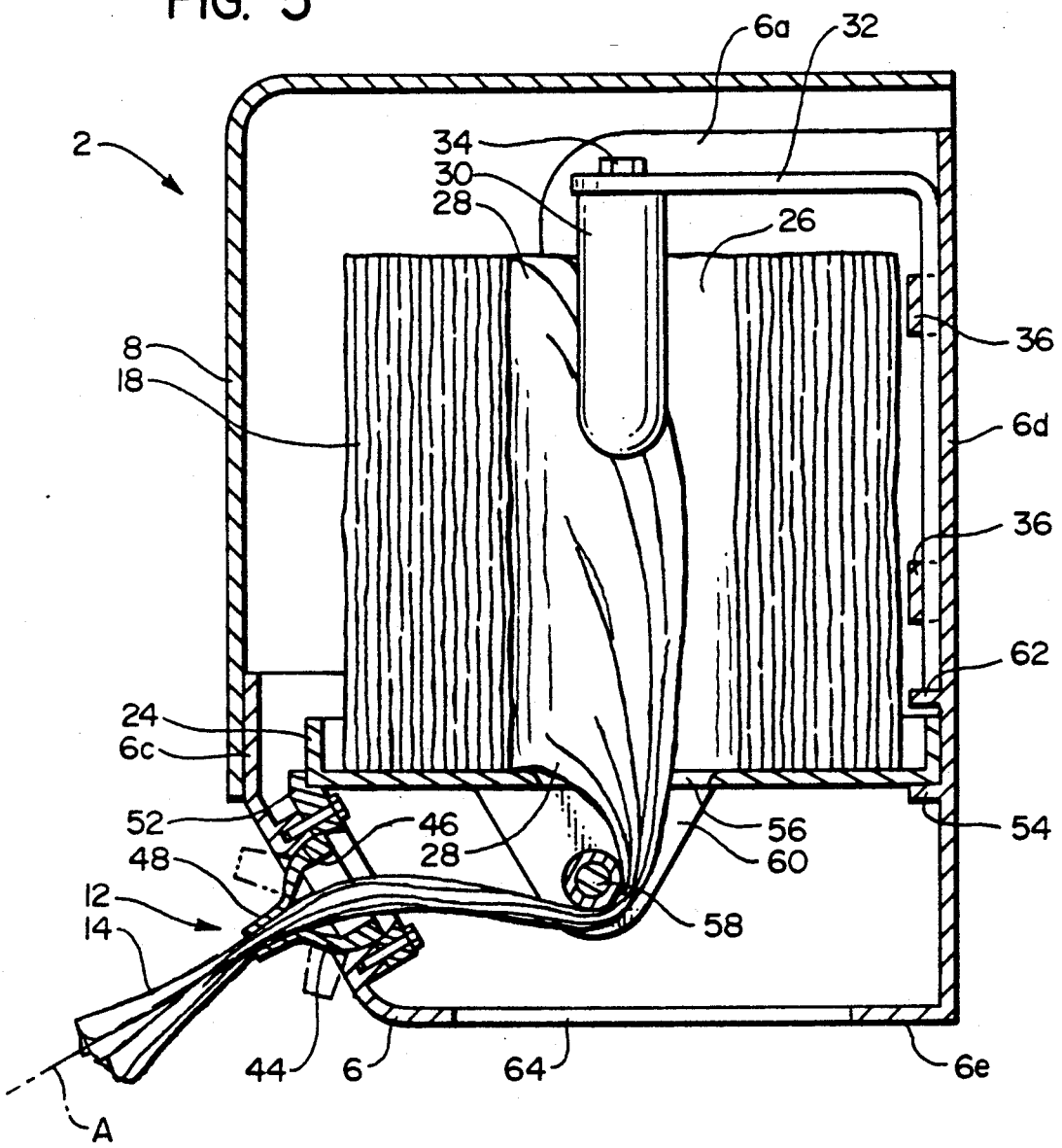
FIG. 5 is a side, cross-sectional view of the sheet dispenser of the preferred embodiment.

An access hole 64 is formed in the bottom surface 6*e* of container 6 (FIG. 5). Access hole 64 is dimensioned and situated to allow easy access to sheet material 14 within container 6. Hole 56, guide bar 58, and funnel 48 are all easily accessible through access hole 64.

Supply rolls 18 are loaded into and sheet material 14 is dispensed from sheet dispenser 2 in the following manner.

To load a supply roll 18 into container 6, cover 8 is rotated, as shown in FIG. 4, in a counter-clockwise manner to expose the service opening 16. L-shaped bracket 32 is then raised to raise stabilizing bar 30 and allow supply roll 18 to be placed onto support member 24. Once supply roll 18 is placed onto support member 24, the L-shaped bracket is lowered until its bottom end contacts stop ledge 62. At that time, stabilizing bar 30 partially penetrates hollow core 26 of supply roll 18.

In the present embodiment, the end 14*a* of sheet material 14 on the surface of hollow core 26 is pulled down through hole 56 in support member 24 by reaching through access hole 64 in the bottom of container 6. The end 14*a* is then fed around guide bar 58 and through the opening 48*a* in funnel 48 of dispenser 12. Cover 8 may then be closed.

Sheet material 14 is dispensed through funnel 48 of dispenser 12 merely by pulling on the end of sheet material 14 that protrudes through funnel 48. The surface friation of the inside surface of funnel 48 applies a dispensing force along the dispensing axis in opposition to the force supplied by a person pulling on the end of sheet material 14. When an individual sheet 20 of sheet material 14 is entirely withdrawn from funnel 48, the perforated junction 22 between the first individual sheet 20 and the following individual sheet 20 leaves the funnel 48. The dispensing force applied by the surface friction of funnel 48 is of appropriate magnitude to cause the first individual sheet 20 to tear away from the following individual sheet 20 at the perforated junction 22.

The diameter of the opening in funnel 48 may be varied to change the surface friction applied to the sheet material. In addition, the texture or material of the inside surface of the opening in funnel 48 may also be varied to change of the surface friction. Accordingly, various weights of sheet material such as paper, nonwoven toweling, wipes, or plastic bags may be dispensed from the sheet dispenser 2 of the present invention merely by varying the diameter and/or surface texture of the opening in funnel 48. The essential characteristic of the sheet material 14 is that it is flexible and have perforations to allow individual sheets to be perforated.

Guide bar 58 is designed such that it rolls or has very low surface friction so that a force necessary to separate one individual sheet from another individual sheet along the perforated junctions is not applied to the sheet material at guide bar 58. Guide bar 58 allows sheet material to be dispensed at various angles to the axis of hollow core of supply role 18 without jamming or allowing one individual sheet to separate from another individual sheet within container 6. Additionally, more than one guide bar may be arranged within container 6 as appropriate to allow placement of dispenser 12 on, for example, a side wall or top of container 6.

Stabilizing bar 30 prevents supply roll 18 from caving in upon itself when supply roll 18 becomes weakened after most of the sheet material 14 has been dispensed therefrom. Instead of falling in upon itself, which often causes jamming of sheet material 14 within paper dispensers, the collapsing inner surface of supply roll 18 contacts stabilizing bar 30 and is held in an upright position, thereby allowing dispensing of sheets from hollow core 26 without jamming.

However, stabilizing bar 30 is fixed at only one end. The other, in this case lower, end is free and does not obstruct the spiraling movement of the point 28 at which sheets are being removed from hollow core 26 around the axis of hollow core 26.

Should the sheet material 14 become jammed inside container 6, or should two individual sheets be separated at a perforated junction inside container 6, the user may obtain sheet material merely by reaching into the interior of container 6 through access hole 64. Sheet material 14 may be dispensed directly through access hole 65, if necessary, or the end of sheet material 14 may be rethreaded by the user through the opening funnel 48 of dispenser 12.

In the present invention, the ball 44 and socket 46 of the dispenser 12 may be made either of disposable or durable materials, depending on the environment in which the sheet dispenser will be used. If disposable materials are used, the ball 44 may be replaced or substituted to accommodate different types of sheets to be dispensed.

Furthermore, dispensing device 12 need not comprise a ball and socket. Any device that allows the dispensing angle to be changed may be used as a dispensing device.

The invention may be embodied in forms other than disclosed above without departing from the spirit or essential characteristics of the invention. The present embodiments are therefore to be considered in all respects as illustrative and not restrictive, the scope of the invention being indicated by appended claims rather than by the foregoing description; and all changes which come within the meaning and range of equivalency of the claims are therefore intended to be embraced therein.

What is claimed is:

1. A sheet dispenser from which sheet material is manually extracted, comprising:

a housing adapted to contain a supply of sheet material;

a dispensing member having a dispensing opening formed therethrough, where the sheet material extends through the dispensing opening to the exterior of the housing along a dispensing axis; and mounting means for rotatably mounting the dispensing member onto the housing such that a dispensing angle between the dispensing axis and a surface of the housing may be manually changed during manual extraction of sheet material.

2. The sheet material dispenser of claim 1, in which:

the dispensing member comprises a funnel projecting from a hollow ball means having first and second openings formed therethrough, where the second opening is substantially coincident with a first end of the funnel and the dispensing opening is formed at a second end of the funnel; and the mounting means comprises a socket means formed on the housing and adapted to receive the ball means such that the ball means can rotate within a limited range about its center; whereby;

the sheet material extends from the supply through the first opening, the second opening, and the funnel to the exterior of the housing.

3. The sheet material of claim 1, further comprising a support member having an aperture formed therethrough on which the supply of sheet material is supported, where the supply is a roll of interconnected individual sheets mounted on the support member with a hollow core of the roll substantially aligned with the aperture of the support member.

4. The sheet material dispenser of claim 3, in which:

the individual sheets are connected along a perforated junction; and the opening in the funnel is dimensioned to apply a frictional force on the sheet material sufficient to separate individual sheets from each other along the perforated junctions.

5. The sheet material dispenser of claim 4, in which an inner surface surrounding the funnel opening is textured to vary the frictional force applied thereby.

6. The sheet material dispenser of claim 3, further comprising a guide bar mounted below the aperture in the support member, where the sheet material passes partially around the guide bar before exiting the housing through the opening in the dispensing member.

7. The sheet material dispenser of claim 3, in which a stabilizer bar fixed at one end within the housing protrudes into the hollow core of the supply of sheet material.

8. The sheet material dispenser of claim 7, in which: (i) a diameter of the stabilizing bar is less than a diameter of the hollow core before any sheet material has been extracted from the supply of sheet material, and (ii) the free end of the stabilizing bar extends only partly through the hollow core.

9. The sheet material dispenser of claim 3, in which an access opening is formed in the housing below the aperture in the support member for allowing access to the sheet material within the housing.

10. The sheet material dispenser of claim 1, further comprising a cover rotatably attached to the housing for covering a service opening formed on a top portion of the housing through which the supply is inserted into the housing.

11. The sheet material dispenser of claim 1, in which an access opening is formed in the housing for allowing access to the sheet material within the housing.

12. A sheet dispenser from which sheet material is manually extracted, comprising:

a housing;

a support member mounted within the housing and having an aperture formed therethrough on which a supply of sheet material is supported, where the supply is a roll of interconnected individual sheets and a hollow core of the roll is substantially aligned with the aperture of the support member;

a dispensing member mounted on a surface of the housing and having an opening formed therethrough, where the sheet material extends from the supply through the opening to the exterior of the housing;

a guide bar mounted below the aperture in the support member, where the sheet material passes partially around the guide bar before exiting the housing in the dispensing member; and mounting means for rotatably mounting the dispensing member onto the housing such that a dispensing angle between the dispensing axis and a surface of the housing may be manually changed during manual extraction of sheet material.

13. The sheet material dispenser of claim 12, in which an access opening is formed in the housing below the guide bar for allowing access to the sheet material within the housing.

14. An sheet dispenser from which sheet material is manually extracted, comprising:

a housing;

a support member mounted within the housing and having an aperture formed therethrough on which a supply of sheet material is supported in a supply roll position, where the supply is a roll of interconnected individual sheets and a hollow core of the roll is substantially aligned with the aperture of the support member;

a dispenser member mounted on a surface of the housing and having an opening formed therethrough, where the sheet material extends from the supply through the opening to the exterior of the housing;

a cover rotatably attached to the housing for covering a service opening formed on a top portion of the housing through which the supply is inserted into the housing; and a stabilizer bar fixed at one end to a stabilizer bracket slideably mounted on the housing, where the stabilizer bracket slides between a lower, stabilizing position in which the stabilizing bar penetrates the hollow core of the supply roll and an upper loading position in which the stabilizing bar is raised through the service opening clear of the supply roll position.

15. The sheet material dispenser of claim 14, in which: (i) a diameter of the stabilizing bar is less than a diameter of the hollow core before any sheet material has been extracted from the supply roll, and (ii) the free end of the stabilizing bar extends only partly through the hollow core.

16. The sheet material dispenser of claim 15, further comprising mounting means for rotatably mounting the dispensing member onto the housing such that a dispensing angle between the dispensing axis and a surface of the housing may be manually changed during manual extraction of sheet material.

17. The sheet material dispenser of claim 16, in which an access opening is formed in the housing below the guide bar for allowing access to the sheet material within the housing.

18. A sheet dispenser from which sheet material is manually extracted, comprising:

a housing;

a support member mounted within the housing and having an aperture formed therethrough on which a supply of sheet material is supported in a supply roll position, where the supply is a roll of interconnected individual sheets and a hollow core of the roll is substantially aligned with the aperture of the support member;

a dispensing member having an opening formed therethrough, where the sheet material extends from the supply through the opening to the exterior of the housing along a dispensing axis;

mounting means for rotatably mounting the dispensing member onto the housing such that a dispensing angle between the dispensing axis and a surface of the housing may be manually changed during manual extraction of sheet material;

a cover rotatably attached to the housing for covering an access opening formed on a top portion of the housing through which the supply is inserted into the housing; and a stabilizer bar fixed at one end to a stabilizer bracket slideably mounted on the housing, where the stabilizer bracket slides between a lower, stabilizing position in which the stabilizing bar penetrates the hollow core of the supply roll and an upper loading position in which the stabilizing bar is raised through the service opening clear of the supply roll position.

19. The sheet material dispenser of claim 18, in which an access opening is formed in the housing below the aperture in the support member for allowing access to the sheet material within the housing.

20. The sheet material dispenser of claim 19, in which:

the dispensing means comprises a funnel projecting from a hollow ball means having a first and second opening formed therethrough, where the second opening is substantially coincident with the opening of the funnel; and the mounting means comprises a socket means formed on the housing and adapted to receive the ball means such that the ball revolves about its center; whereby the sheet material extends from the supply through the first opening, the second opening, and the funnel to the exterior of the housing.

21. The sheet material dispenser of claim 20, in which:

the individual sheets are connected along a perforated junction; and the opening in the funnel is dimensioned to apply a frictional force on the sheet material sufficient to separate individual sheets from each other along the perforated junctions.

22. The sheet material dispenser of claim 21, in which an inner surface surrounding the funnel opening is textured to vary the frictional force applied thereby.

23. A process of dispensing sheet material comprising the steps of:

providing a housing which is adapted to contain a supply of sheet material;

providing a socket means around an orifice on a surface of the housing;

mounting a ball means in the socket means such that the ball means revolves in the socket means about the center of the ball means, the ball means having first and second openings formed thereon;

providing a funnel on the ball means, an opening of the funnel being coexistent with the second opening;

threading an end of the supply of sheet material through the first opening;

threading an end of the supply of sheet material through the first opening;

threading the end through the second opening;

threading the end through the funnel opening to the exterior of the housing; and manually extracting individual sheets of sheet material from the housing through the dispensing funnel.

* * * * *